United States Patent [19]

Vuick

[11] Patent Number: 4,659,084

[45] Date of Patent: Apr. 21, 1987

[54] GOLF SWING TRAINING APPARATUS

[76] Inventor: Michael C. Vuick, Pittsburgh, Pa.

[21] Appl. No.: 766,911

[22] Filed: Aug. 16, 1985

Related U.S. Application Data

[63] Continuation of Ser. No. 564,572, Dec. 22, 1983, abandoned, which is a continuation-in-part of Ser. No. 386,533, Jun. 9, 1982, abandoned, which is a continuation-in-part of Ser. No. 364,506, Apr. 1, 1982, abandoned.

[51] Int. Cl.[4] ..... A63B 69/36

[52] U.S. Cl. ..... 273/183 B; 273/186 C; 273/188 R; 273/190 R

[58] Field of Search ..... 434/253, 252; 272/70, 272/93, 96, 97, 145, 146, 78; 128/25 B; 273/26 R, 188 R, 189 R, 188 A, 190 R, 185 R, 186 C, 187 R, 195 R

[56] References Cited

U.S. PATENT DOCUMENTS

| | | | |
|---|---|---|---|
| 1,065,022 | 6/1913 | Bell | 272/146 |
| 1,211,026 | 1/1917 | Yeager | 273/185 R |
| 1,409,688 | 3/1922 | Edgar | 273/186 C |
| 1,936,143 | 11/1933 | Shea | 273/190 R |
| 1,978,499 | 10/1934 | Loveridge | 272/78 |
| 2,190,895 | 2/1940 | Turpin | 128/25B |
| 2,611,610 | 9/1952 | Hara | 273/190 R X |
| 3,698,721 | 10/1972 | Stewart | 273/188 R X |
| 3,774,597 | 11/1973 | Root | 128/25 B |
| 3,787,048 | 1/1974 | Bock | 272/145 |
| 3,921,976 | 11/1975 | Lane | 273/26 R |
| 3,942,802 | 3/1976 | Wright | 273/186 C |
| 4,326,718 | 4/1982 | Kiehl | 273/190 R |
| 4,456,250 | 6/1984 | Perrone | 273/26 R |

FOREIGN PATENT DOCUMENTS

| | | | |
|---|---|---|---|
| 764297 | 8/1967 | Canada | 273/190 R |

*Primary Examiner*—George J. Marlo

*Attorney, Agent, or Firm*—Buell, Ziesenheim, Beck & Alstadt

[57] ABSTRACT

The apparatus comprises a U-shaped base member which defines the place where the golfer stands and adjustably supports one or more masts with boom extending therefrom toward the golfer, each boom carrying at its extended end, a member contacting the golfer's body. One such member is positioned from the rear between the golfer's knees so that on his swing, one side of the member touches the inside of his left knee on his backswing only and the other side of the member touches the inside of his right knee on his downswing only. Another such member is positioned from the rear to contact the outside of the golfer's left knee on his downswing only. Another such member is positioned from the front against any side of the golfer's head. Another such member is positioned from the rear against the outside of the golfer's right knee so as to keep his weight on the inside of his right foot. The apparatus also includes a flexible, elongated curtain supported at a low height in front of the place where the golfer stands on the far side of his ball whereby, by swinging his club on his downswing so as to travel parallel to that curtain but without striking it, the golfer swings in an "inside-out" arc.

8 Claims, 10 Drawing Figures

GOLF SWING TRAINING APPARATUS

This application is a continuation of my application Ser. No. 564,572, filed Dec. 22, 1983, now abandoned, which was a continuation-in-part of my application Ser. No. 386,533, filed June 9, 1982, now abandoned, which was a continuation-in-part of my application Ser. No. 364,506, filed Apr. 1, 1982, now abandoned.

This invention relates to an apparatus for training golfers to swing in the manner which has long been recommended as producing the best results. It is more particularly concerned with such apparatus which assists a golfer in properly positioning his head and legs so as to achieve such a swing.

BACKGROUND OF THE INVENTION

The essentials of a good golf swing are well-known but have been difficult to master by the great majority of golfers. A considerable number of mechanical devices has been put forward to train a golfer in perfecting the desired swing. All of such devices known to me attempt to obtain the desired result by providing tracks for the club head forcing it to conform to predetermined paths in its backswing and its downswing. An example is found in Mark U.S. Pat. No. 3,489,146 of Jan. 13, 1970, the apparatus of which includes separate arcuate tracks for the backswing and the power or downswing, and uses means attached to the club head which correspond to guide means on the tracks. The theory behind all such track guides is that if the golfer practices his swing in those devices, his physical movements governing the swing, will, from habit, be carried over when he is on the golf course, with the desired result. This is known as "grooving" the swing. The fact appears to be, however, that swinging the club in an artificial groove does not, in many, if not most cases, "groove" a golfer's swing.

SUMMARY OF APPLICANT'S INVENTION

Right-handed golfers are advised to keep their heads still, to keep their weight on the inside of the right foot, and to shift their weight by moving their legs at the top of the swing to effect a full shoulder turn, which produces maximum power. In the description which follows my apparatus is described for right-handed golfers only, but it may be adapted to left-handed golfers as well by interchanging "right" and "left" in the following description and claims. I have discovered that fixing in practice the position of the knees and head at certain points during the swing greatly facilitates the ability of the golfer to duplicate those positions on the fairway and so swing in the approved manner, and have invented a relatively simple training apparatus for that purpose. I have also discovered that in practice a golfer can consistently control his downswing to an "inside-parallel" arc, to be defined hereinafter, if he is provided with targets for the path of his club. My apparatus comprises, briefly, an open frame in which the golfer stands carrying adjustable means for positioning his head, adjustable means for positioning his right knee, and adjustable means for positioning his left knee, at certain points or times during the swing in a manner to be described, and an adjustable target to be described.

DESCRIPTION OF PREFERRED EMBODIMENT

Figure 1:
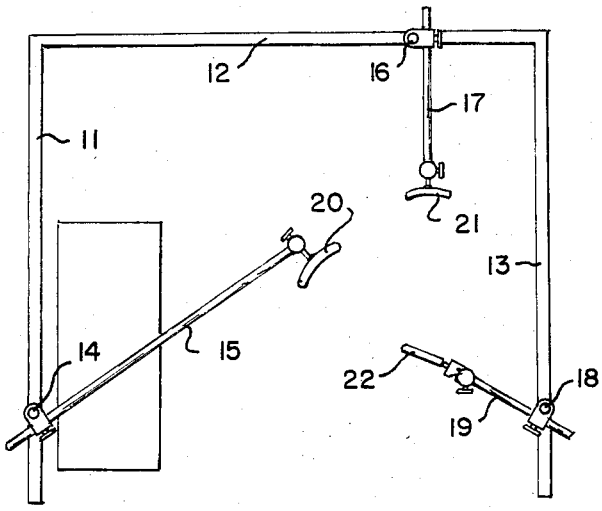
FIG. 1 is a plan of my apparatus.
Figure 2:
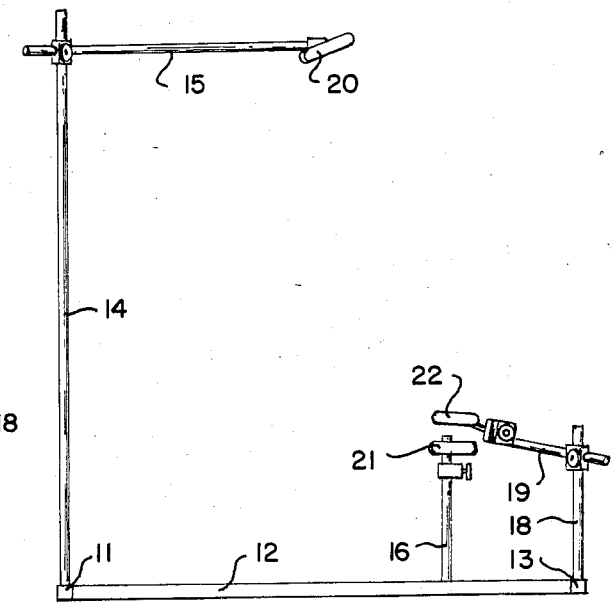
FIG. 2 is a front elevation of the apparatus of FIG. 1.
Figure 3:
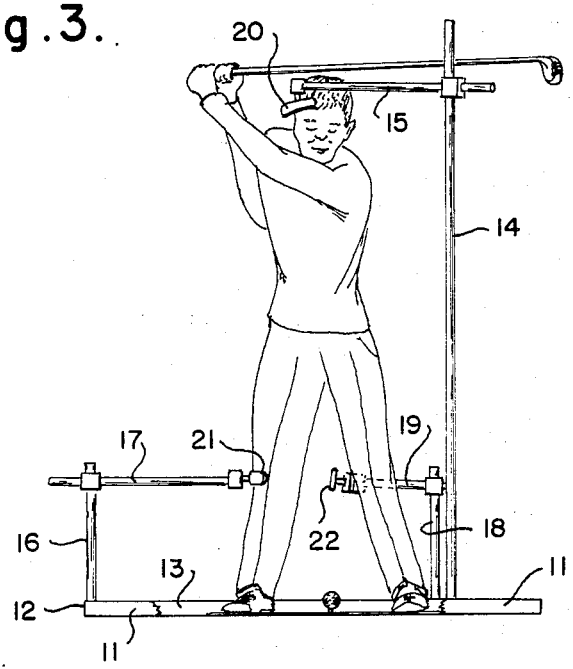
FIG. 3 is a side elevation of the apparatus of FIG. 1 as it appears when being used by a golfer.

A first embodiment of my apparatus shown in FIGS. 1–6 inclusive is supported on the ground by a U-shaped frame comprising side members 11 and 13 extending on the right and left sides respectively from the ends of rear member 12. The open end of the frame is the front. To side member 11 near its free end is affixed an upright mast 14 of about a man's height, which at its upper end carries a horizontal boom 15 extending inwardly of the frame. The height of the boom 15 on mast 14 is adjustable and the extension of the free end of the boom from the mast is also adjustable, as well as is the angle between boom 15 and the vertical plane of side member 11. A short mast or upright 16 of about knee height is affixed to rear member 12 somewhat nearer side member 13 than side member 11. Mast 16 supports at its upper end a short horizontal boom 17 adjustable as to height and the distance of its free end from mast 16. A third short mast or upright 18 about the same height as mast 16 is affixed to side member 13 near its free end and supports on its upper end a short boom 19 adjustable in the same way as booms 15 and 17 previously mentioned. Conventional devices such as collars and set screws are made part of my apparatus to effect those adjustments and lock the various members in their adjusted positions.

Boom 15 at its free end carries a pad 20 which bears against a golfer's head. It may engage the head on any side, as long as the golfer finds it comfortable, and his head is steadied thereby. Boom 17 carries at its free end a pad 21 shaped to fit against the outside of the golfer's right knee. Boom 19 carries at its free end a pad 22 shaped to be positioned between a golfer's knees for a purpose to be described. The pads are affixed to their respective booms by ball-and-socket or like joints which allow their positions relative to their supporting booms to be adjusted and then locked.

In use my apparatus hereinabove described is adjusted so that when a golfer stands inside the U-shaped frame with his back to side member 13, pad 20, rests, for example, against his temple. Pad 21, suitably curved, presses against the outside of his right knee. Flat pad 22 initially makes contact on one side with the golfer's left knee. To the extent above mentioned my apparatus is adjusted to the position assumed by the golfer when he addresses the ball. Pad 20 keeps his head from moving when he swings. Pad 21 pressing against the outside of his right knee keeps the golfer's weight to the inside of his right foot, so as to permit a full shoulder turn on the back swing. Pad 22 is in contact with the golfer's left knee at the top of his backswing and on the downswing it insures the movement in that direction of his right knee as he shifts his weight. That shift disengages his right knee from pad 21. The control of his body so effected promotes the proper weight distribution and coiling and uncoiling of the body. Use of my apparatus teaches a golfer to hold his head still, how to stand, and how to move his knees on the downswing. With practice he becomes able to assume and hold those positions without the use of my apparatus.

Figure 4:
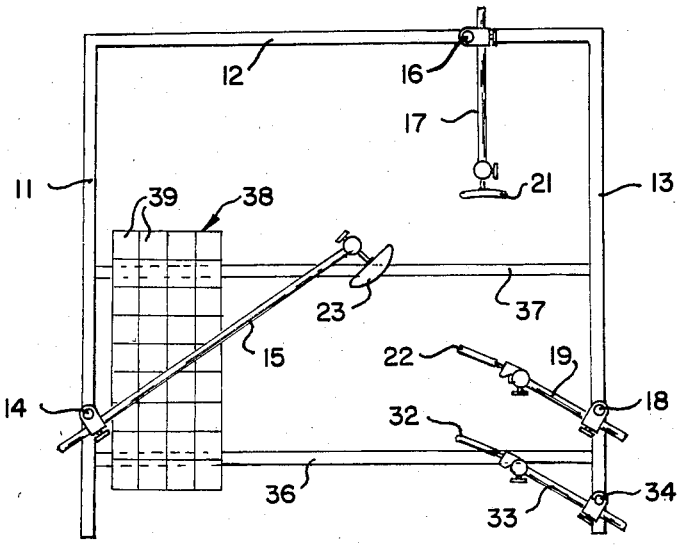
FIG. 4 is a plan of modified apparatus of my invention.
Figure 5:
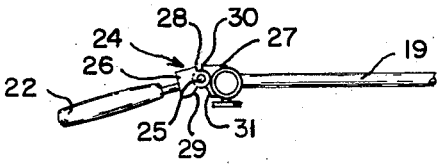
FIG. 5 is a detail in plan of the apparatus of FIG. 4.
Figure 6:
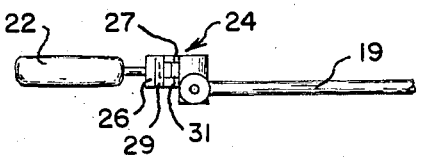
FIG. 6 is an elevation of the apparatus of FIG. 5.

My apparatus above described may be modified in certain respects to accommodate variations between individual golfers. Those modifications are illustrated in FIGS. 4, 5 and 6. While pad 20 is generally useful in positioning the head of a golfer it is not essential that a golfer's head remain totally immobile during his swing. A certain amount of rotational movement of the head on the neck is permissible as long as the level of the head is not varied. Some golfers have a tendency to drop their heads, which is detrimental, and those golfers benefit by the use of my head positioning means. Other golfers do not have that tendency and they may not need head positioning means. Golfers who rotate their heads may find a pad 20 curved as shown in FIG. 1 uncomfortable and for such golfers I substitute a pad 23 oppositely curved, that is, convex-out, as shown in FIG. 4, rather than concave-out. Pad 23 provides reduced contact area between pad and head.

One of the most critical components of the golf swing is the movement of the legs. In rotating or coiling the body on the backswing the left knee should move to the right. Pad 22 is aligned to contact the right side of the left knee on the backswing, which tells the golfer that the proper weight transfer is taking place. On the downswing, the left side of the right knee contacts the pad 22, which tells the golfer that the right knee has moved to the left and that the proper weight transfer has taken place. To indicate further a proper weight transfer, a pad 32 is positioned to the left of the left knee, so that the left knee makes contact with pad 32 urging that pad to move in the direction of the downswing. That contact occurs only on the downswing. To accommodate the impacts of the knee, pad 22 is mounted on hinges or pivots. Pad 32 is shown in FIG. 4 and is adjustably attached to the free end of boom 33 adjustably supported on a mast 34 which is fixed upright on side member 13 of my apparatus. Pad 32 may be used in place of pad 22 or with that pad.

The pivotal mounting for pad 22 is shown in FIGS. 5 and 6. Pad 22 is connected to boom 19 by hinge 24 which comprises elements 26 and 27 hinged about a vertical pivot 25. The adjoining edges 28 and 30 of elements 26 and 27 respectively on the side of hinge 24 facing rear member 12 of my apparatus meet when pad 22 and boom 19 are in alignment, but adjoining edges 29 and 31 of elements 26 and 27 on the opposite side of hinge 24 are beveled so that pad 22 can swing through a considerable angle with respect to boom 19 in the direction of movement of the golfer's right knee. Hinge 24 thus limits the swing of pad 22 toward pad 21 only. On the backswing the right side of the left knee makes contact with pad 22, urging that pad in the direction of the backswing. On the downswing the left side of the right knee makes contact with pad 22 and moves it in the direction of the downswing causing it to rotate on hinge 24. On the downswing the outside of the left knee contacts pad 32 in the direction of that swing.

In order to make my U-frame more rigid I connect side members 11 and 13 at ground level by flat members 36 and 37 shown in FIG. 4. A driving mat 38 may be positioned within my U-shaped frame on top of members 36 and 37. A driving mat subdivided by rectangular coordinate lines into squares 39 of about 4 inches on a side is useful in assisting a golfer to address his ball.

Golfers are generally admonished to keep their hands close to the body on the downswing so that the arc described by the club head is "inside-out" that is, tight to the point of impact of the club head on the ball. The term "inside-out" is not entirely accurate as the desired swing is from the inside to the ball and then parallel to the desired direction of flight of the ball. A better term would be "inside-parallel". Many golfers find it difficult to control their swing in the desired manner, no matter how it is described. I have found that this difficulty arises because the golfer does not realize how far "outside" his shoulders are turned at the top of his backswing and, therefore, begins his downswing "outside" no matter how conscientiously he attempts to swing "inside". I have found that an "inside-out" swing, so-called, can be achieved relatively easily if the golfer is provided with a guide or target for the club at or near the bottom of his downswing, positioned just outside the arc of an "inside-parallel" swing, so that the club will not strike it if properly swung. In addition, the guide must not inspire any fear of striking it. If it does, the golfer's fear is quite likely to cause him to tighten up and cramp his swing.

The guide I employ is made of lightweight flexible material such as foam rubber of the like which, if struck by golfer's club, is displaced without deflecting the club and which returns to its original position thereafter. I have devised two versions of such a guide, each of which may be used alone, or together in combination solely or jointly with my apparatus first described herein.

Figure 7:
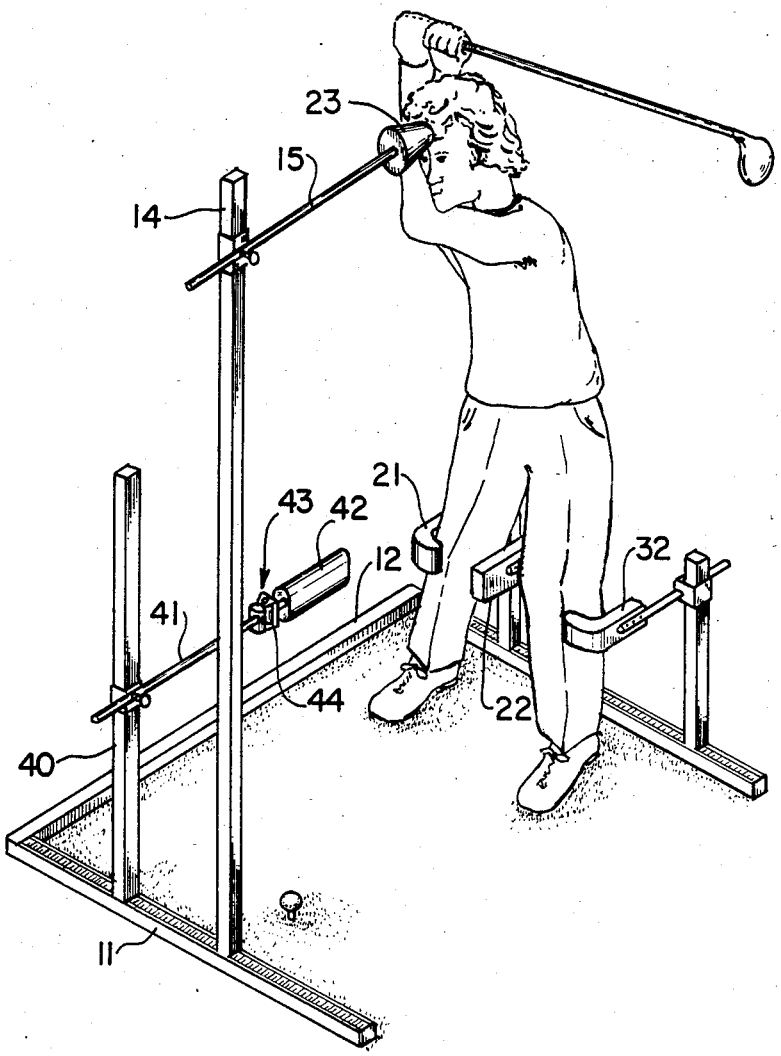
FIG. 7 is an isometric view of further modified apparatus of my invention.

In FIG. 7 illustrating a second embodiment of my invention the first or target version of of my guide is shown together with other elements of my apparatus. To side member 11 of my U-shaped frame is affixed an upright mast 40, its position on member 11 between mast 14 and side-member 12 being adjustable. Mast 40 supports horizontal boom 41, its position on mast 40 being adjustable and its length with respect to mast 40 being also adjustable in the way described hereinabove for my other embodiments. At its free end boom 41 carries a foam rubber target 42 mounted thereon with its long dimension horizontal by a hinge 43 with a vertical pivot. The flexibility of the foam rubber or like material and the hinge 43 permit movement of target 42 in both ways from the vertical plane of boom 41 if it is struck by the club, either on the backswing or the downswing.

In use the positions of mast 40 and boom 41 are adjusted to the individual golfer so as to position target 42 in front of and at or slightly below the level of his hands when he addresses the ball, but spaced therefrom as is shown in FIG. 7. Target 42 gives the golfer a point of reference for his downswing. It is positioned experimentally so that neither his hands nor club shaft strike it when his swing is "inside-out" but do strike it if he overswings. However, he knows that his mistake will merely deflect the target without causing any shock or damage. It differs from the respective pads of my other embodiments described hereinabove which are positioned to make contact with the golfers body at appropriate points in a desired swing.

Figure 8:
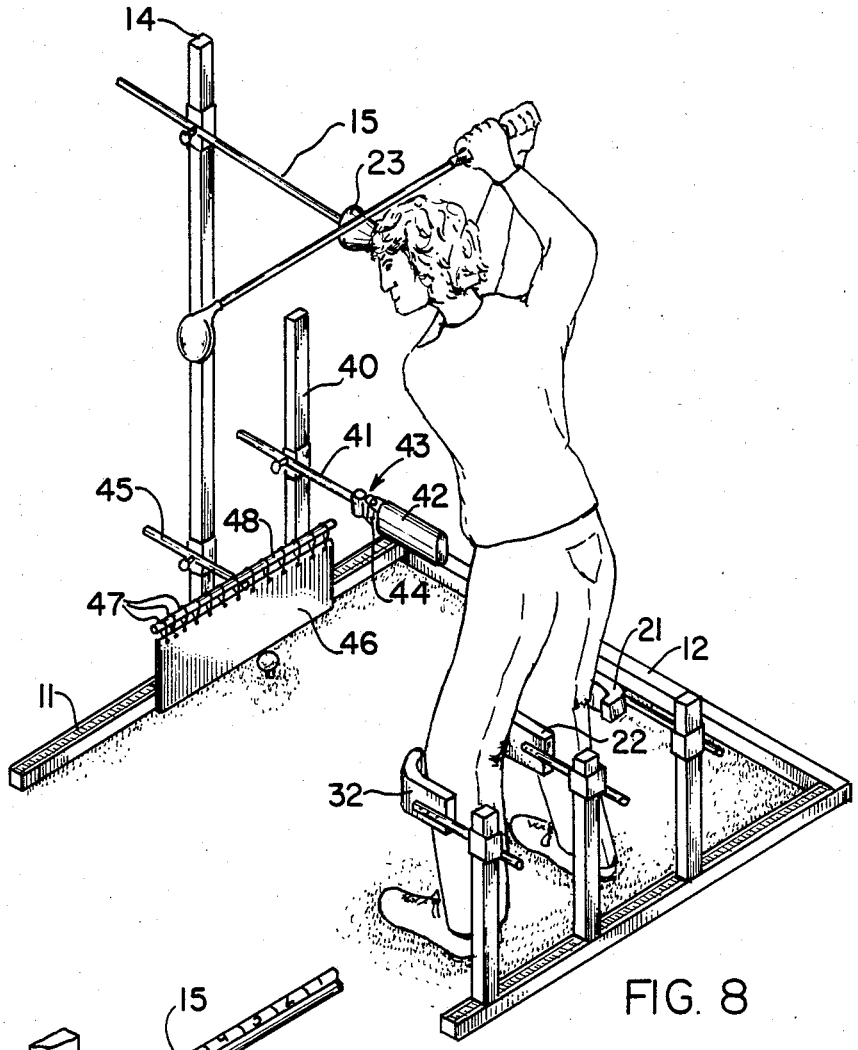
FIG. 8 is an isometric view from the rear of a still further modified apparatus of my invention.

The curtain version of my guide is shown in FIG. 8 which also illustrates the second embodiment of my invention. Mast 14 carries a second horizontal boom 45, the length of which from mast 14 may be varied. Boom 45 carries at its outside end a horizontal member 48 about three feet long disposed parallel to side member 11. A curtain of rubber or the like 46 is hung from cross member 48 by loops 47 so that its bottom edge touches the ground or mat. The vertical dimension of curtain 46 need be only on the order of 15 inches or so and its thickness about $\frac{1}{8}$ of an inch. The length of boom 45 is adjusted to position curtain 46 between the ball and frame member 11 about 3 inches from the ball. If desired, boom 45 may be mounted on a mast separate from mast 14.

My curtain 46 version above described, like my target version previously described, provides a reference element for the golfer's downswing, as has been described. In addition, curtain 46 is long enough to establish the direction of an "inside-parallel" swing. Further, my adjustable boom 45 makes possible the calibration of the position of the golfer with respect to his ball in the way described in the following paragraph.

In the two versions of the second embodiment of my invention above described, all three pads, 21, 22 and 32, are shown mounted on masts which are affixed to side element 13 of my U-shaped frame. The masts and booms for those pads may be arranged in any way which does not interfere with the movement of the golfer's legs during his swing.

Figure 9:
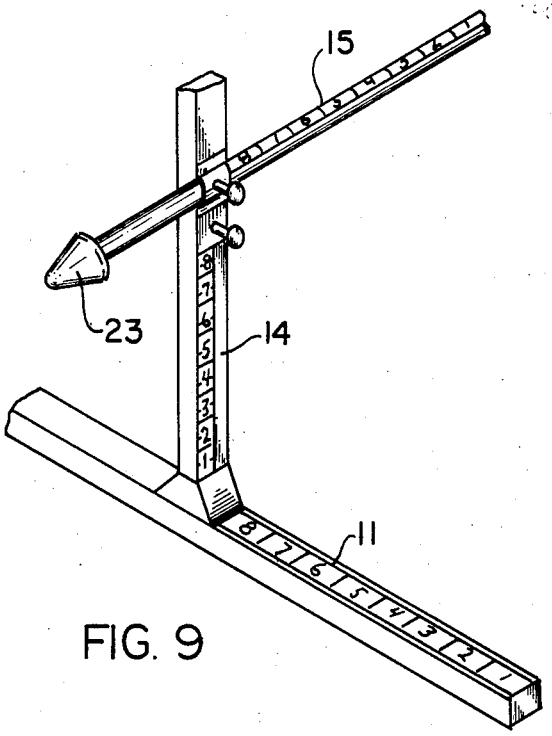
FIG. 9 is a detail of the calibrated frame mast and boom apparatus of my invention.
Figure 10:
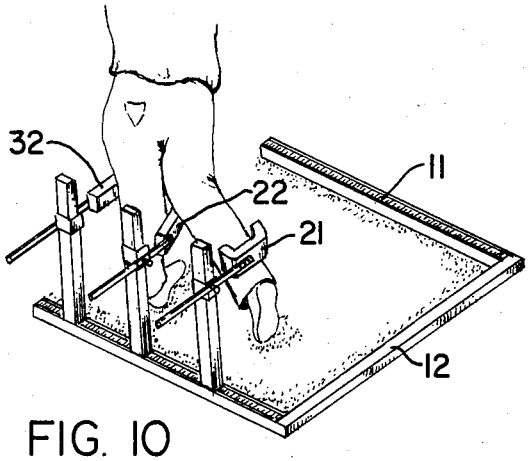
FIG. 10 is a partial view from the rear of a golfer using the apparatus of FIGS. 1–6 inclusive showing the position of his right knee against pad 22 on the downswing.

My frame members 11, 12 and 13, my various masts 14, 16, 18, 34 and 40 and my booms 15, 17, 19 and 33 and 41 are marked off along their lengths in units of length as is shown in FIG. 9 so that the desired settings of the frames, masts and booms with respect to each other for any individual golfer may be recorded and the settings repeated from that record. The settings of some or all of them for the same golfer will, of course, differ for different clubs.

While I have shown and described presently preferred embodiments of my invention, I wish it to be understood that the invention is not limited thereto, but may be otherwise variously embodied within the scope of the following claims.

I claim:

1. Golf swing training apparatus for positioning a golfer's legs comprising (a) a U-shaped base member on which the apparatus is supported, said base member defining an area within which a golfer can stand and address a golf ball, (b) a boom adjustably supported by said base member and adapted to be positioned behind and toward the place where the golfer stands within said area while addressing a golf ball, (c) a between-knees contacting member carried by the extended end of the boom, (d) said boom being adjustable to position said between-knees contacting member between the golfer's knees when he addresses the ball so that on his swing one side of said member touches the inside of the golfer's left knee on his backswing only and the other side thereof touches the inside of the golfer's right knee on his downswing only.

2. Apparatus of claim 1 including an additional boom supported by said base member behind the place where the golfer stands and extending toward that place and a left knee-contacting member carried by the extended end of said additional boom, said additional boom being adjustable to position said left knee-contacting member against the outside of the golfer's left knee on the downswing only.

3. The apparatus of claim 1 including an additional boom supported by said base member in front of the place where the golfer stands and extending toward that place and a head-contacting member carried by the extended end of said additional boom, said additional boom being adjustable to position said head-contacting member against any side of the golfer's head.

4. The apparatus of claim 1 in which said between-knees-contacting member is elongated, carried at one end by said boom on a vertical pivot and is movable about that pivot from alignment with said boom to out of alignment with said boom in the downswing direction only.

5. The apparatus of claim 1 in which said base member comprises an elongated rear member and two elongated side members extending in the same direction from opposite ends of said rear member respectively.

6. Apparatus of claim 1 including an additional boom supported by said base member behind the place where the golfer stands and extending toward that place and a right knee-contacting member carried by the extended end of said additional boom, said boom being adjusted to position said right knee-contacting member against the outside of the golfer's right knee so as to keep the golfer's weight on the inside of his right foot.

7. Apparatus of claim 1 for inducing an "inside-parallel" swing by the golfer at the ball including an additional boom adjustably supported by said base member in front of the place where the golfer stands and extending toward that place and a low, flexible elongated curtain member carried by the extended end of said boom, said boom being adjustable to position said curtain member in front of the golfer on the far side of his ball, whereby by swinging his club on his donwswing so as to travel parallel to that curtain member, but without striking it, he swings in an "inside-parallel" arc.

8. Apparatus of claims 1, 2, 3, 6 or 7 in which said boom or booms and said base member are marked off in units of length so that the desired positions of said boom or booms and said knee-contacting member or members carried by said boom or booms for an individual golfer may be recorded in said units.

* * * * *